US005146741A

United States Patent [19]

Sood

[11] Patent Number: 5,146,741

[45] Date of Patent: Sep. 15, 1992

[54] GASEOUS FUEL INJECTOR

[75] Inventor: Virendra M. Sood, Encinitas, Calif.

[73] Assignee: Solar Turbines Incorporated, San Diego, Calif.

[21] Appl. No.: 582,739

[22] Filed: Sep. 14, 1990

[51] Int. Cl.[5] ..... F02C 7/22; F02G 1/00

[52] U.S. Cl. ..... 60/39.55; 60/740

[58] Field of Search ..... 60/737, 740, 748, 746, 60/39.53, 39.55, 742

[56] References Cited

U.S. PATENT DOCUMENTS

| | | | |
|---|---|---|---|
| 3,570,242 | 3/1971 | Leonardi | 60/737 |
| 4,070,826 | 1/1978 | Stenger et al. | 60/39.66 |
| 4,327,547 | 5/1982 | Hughes et al. | 60/39.55 |
| 4,483,137 | 11/1984 | Faulkner | 60/39.55 |
| 4,533,314 | 8/1985 | Herberling | 431/4 |
| 4,761,948 | 8/1988 | Sood et al. | 60/39.281 |
| 4,833,878 | 5/1989 | Sood et al. | 60/39.06 |

*Primary Examiner*—Richard A. Bertsch
*Assistant Examiner*—Howard R. Richman
*Attorney, Agent, or Firm*—Larry G. Cain

[57] ABSTRACT

The use of water injection for reduction of NOx emissions in gas turbine engines is well known. Many of the injectors used to supply water to the combustion chamber have used existing dual fuel injectors which are expensive, provide poor mixing, combustion and ineffective water conservation. The present gaseous fuel injector includes a device to cause the swirling of water at an outlet end of the injector, a plurality of tangentially angled passages to cause the swirling of the gaseous fuel and a device for directing a portion of the air into contact with the flow of fuel prior to entering the combustor section. The swirling of the water, gaseous fuel and the air are in the same direction and are all aerodynamically additive resulting in an efficient low cost gaseous fuel injector to reduce NOx emissions.

27 Claims, 5 Drawing Sheets 80
88
54
90
92
86
84
54
96
94
98
32
102
126
104
4
5
82
A
100
4
5

GASEOUS FUEL INJECTOR

DESCRIPTION

1. Technical Field

This invention relates generally to fuel injector and more particularly to gaseous fuel injectors having water injection capabilities for use with gas turbine engines.

2. Background Art

It is well known that water in liquid or vapor state has a significant effect on nitric oxide production in flames burning in air. Thermal nitric oxide production has been found to be strongly dependent on the temperature of the flame and on the oxygen concentration, in a somewhat complex relationship. Water reduces the flame temperature and also the oxygen concentration. The combination of these effects results in a large reduction in the rate of nitric oxide production.

In general, fuel injectors for use with gas turbine engines are used to continuously inject fuel into a combustor section. In attempting to reduce pollution and increase power output, past fuel injection systems have incorporated separate fuel injectors for water and fuel injection and/or injectors with dual injection capabilities. For example, a method for reducing nitric oxide emissions from a gaseous fuel combustor is disclosed in U.S. Pat. No. 4,533,314, issued to Paul V. Herberling on Aug. 6, 1985. The method includes the introduction of a combustion gas, such as air, into a combustion chamber and introducing a fuel gas into the same chamber. In addition a cooling gas, such as steam, is interleaved between the combustion gas and the fuel gas substantially at the point where they are introduced into the chamber.

In many cases a dual fuel (gaseous and liquid) injector is used to inject water into the combustion section. The water is supplied through the air assist passage of the fuel injector when operating on liquid or gaseous fuels or through the liquid fuel passage of the fuel injector when operating on gaseous fuels. As the dual fuel injectors have multiplicity of passages for air assist, gaseous fuel and liquid fuel, they tend to be complex and expensive. Furthermore, it is difficult to optimize the fuel-/air/water mixing processes to obtain high water effectiveness for NOx reduction for both gaseous and liquid fuels. For industrial gas turbines that run primarily on gaseous fuels an inexpensive gas-only fuel injector with water injection capability is cost effective and can be optimized for high water effectiveness for NOx emission reduction.

The problems as mentioned above complicate the structures, increase cost and complicate the system design used to reduce pollution and increase power output.

The present invention is directed to overcoming one or more of the problems as set forth above.

DISCLOSURE OF THE INVENTION

In one aspect of the present invention a gaseous fuel injection system for a gas turbine engine including a gaseous fuel injector is disclosed. The engine is comprised of a turbine section having a gas producing section; a combustor section being positioned in working relationship to the turbine section and having an inlet end and an outlet end, the combustor section further having an outlet flow exiting the outlet end for driving the turbine section; a compressor section being driven by the gas producing section of the turbine section and having a combustion air flow therefrom, said combustion air flow being in fluid communication with the inlet end of the combustor section, a device for causing a flow of fuel during operation of the gas turbine engine, the gaseous fuel injector includes an outlet end having an exit surface thereon, a water injection passage being substantially centered at the outlet end and exiting the exit end, a plurality of gaseous fuel passages surrounding the water injection passage near the outlet end and having the flow of fuel exiting therethrough during operation of the gas turbine engine, and means for directing a portion of the air flow into contact with the flow of fuel exiting the exit surface prior to entering the combustor section, means for causing the swirling of the gaseous fuel and the combustion air flow prior to entering the combustor section, and means for causing the swirling of water at the outlet end, and each of the directing means and the swirling means imputing an angular momentum which is aerodynamically vectorially additive.

In another aspect of the present invention, a gaseous fuel injector adapted for use with a gas turbine engine is disclosed. The gas turbine engine has a combustor section, a device for causing a flow of fuel and a compressor section for causing a combustion air flow. The gaseous fuel injector is comprised of an outlet end having an axis A and an exit surface thereon; a water injection passage having a flow of water therein during operation of the gas turbine engine and being substantially centered at the outlet end; a plurality of gaseous fuel passages surrounding the water injection passage at the outlet end and exiting through the exit surface so that during operation of the gas turbine engine a flow of fuel can exit therethrough; means for directing a portion of the combustion air flow into contact with the flow of fuel prior to entering the combustor section during operation of the gas turbine engine; means for causing the swirling of gaseous fuel and the combustion air flow prior to entering the combustor section; means for causing the swirling of water at the outlet end; and each of the directing means and the swirling means imputing an angular momentum which is aerodynamically vectorially additive.

BEST MODE FOR CARRYING OUT THE INVENTION

Figure 1:
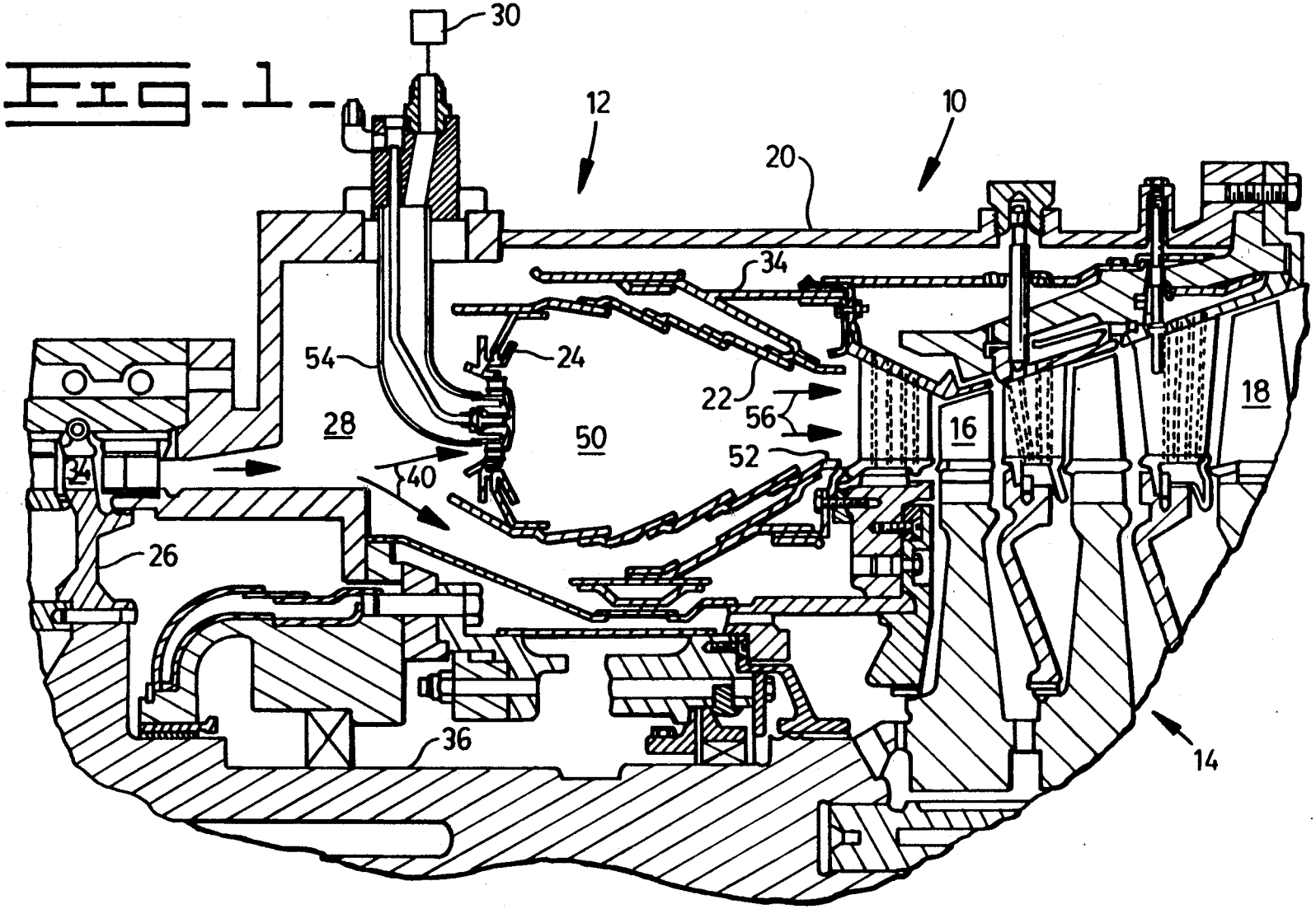
FIG. 1 is a partial sectional side view of a gas turbine engine disclosing the gaseous fuel injection system of this invention.

Referring to FIG. 1, a gas turbine engine 10, not shown in its entirety, has been sectioned to show a gaseous fuel injection system 12, a turbine section 14 having a gasifier turbine section 16 and a power turbine section 18, an outer case 20, a combustor section 22 having an inlet end 24, a compressor section 26 and a compressor discharge plenum 28 fluidly connected to the compressor section 26 of the engine 10. The engine 10 further includes a device 30, not shown in its entirety, for causing a flow of fuel (designated by the arrows 32) during the operation of the engine 10. The plenum 28 is partially defined by the outer case 20 and a multipiece inner wall 34 partially surrounding the turbine section 14 and the combustor section 22. The compressor section 26 includes a plurality of rotatable blades 34 attached to a longitudinally extending center shaft 36 driven by the gasifier turbine section 16. During operation of the engine 10, the compressor section 26 produces an air flow which is divided into a cooling portion and a combustion portion (designated by arrows 40). The combustion air flow 40 is in fluid communication with the inlet end 24 of the combustor section 22. For illustration convenience, only a single stage of a multistage axial compressor section 26 is shown. The combustor section 22 further includes a combustion chamber 50 positioned in fluid communication with the plenum 28 and in working relationship to the turbine section 14. The inlet end 24 is nearest the compressor section 26, and an outlet end 52 is further included in the combustor section 22. A plurality of gaseous fuel injector 54 (one shown) are in communication with the chamber 50 near the inlet end 24. During operation of the engine 10, an outlet flow (designated by arrow 56) exits the outlet end 52 and drives the turbine section 14.

Figure 2:
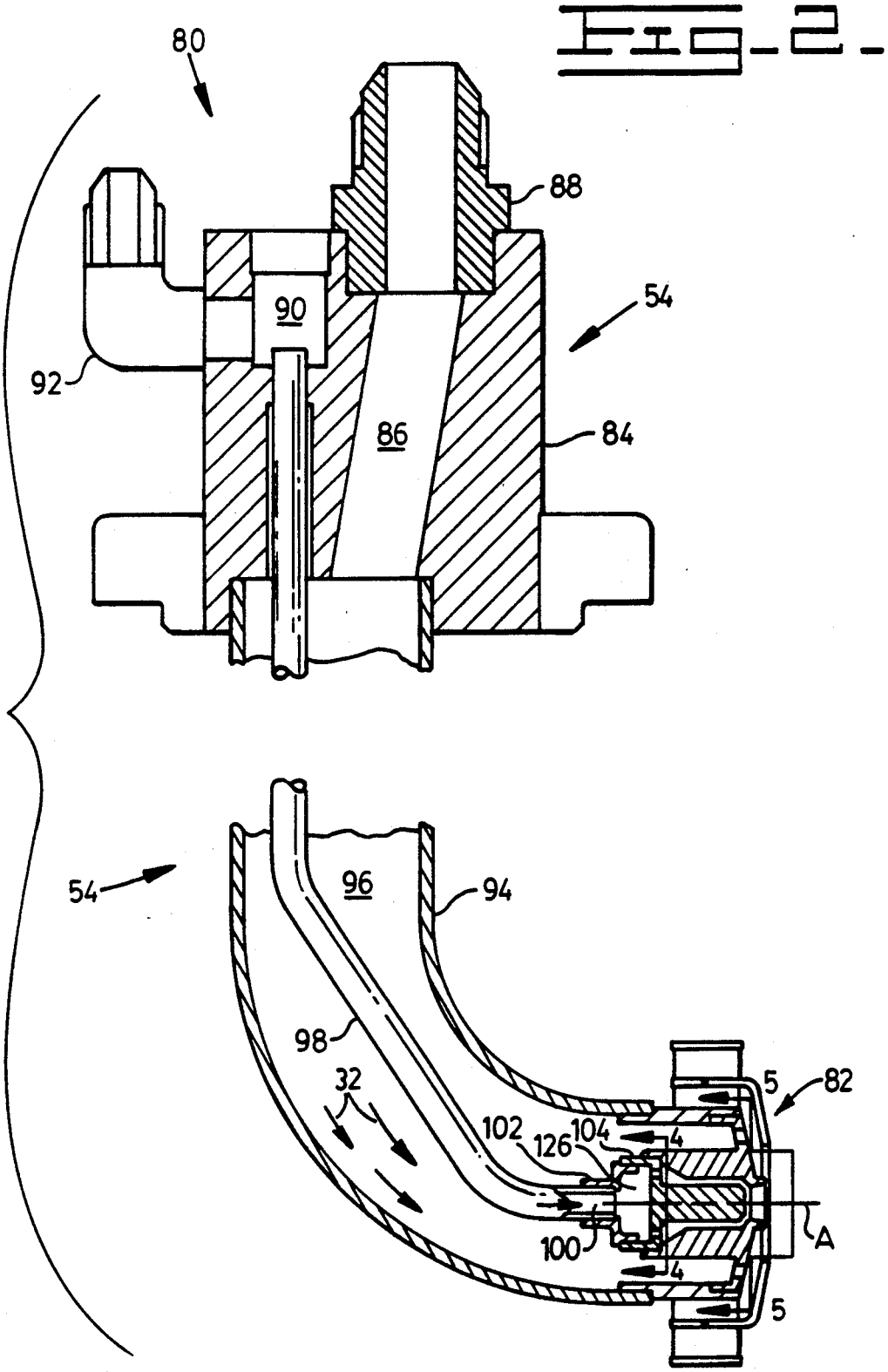
FIG. 2 is an enlarged sectional view of one of the gaseous fuel injector.
Figure 3:
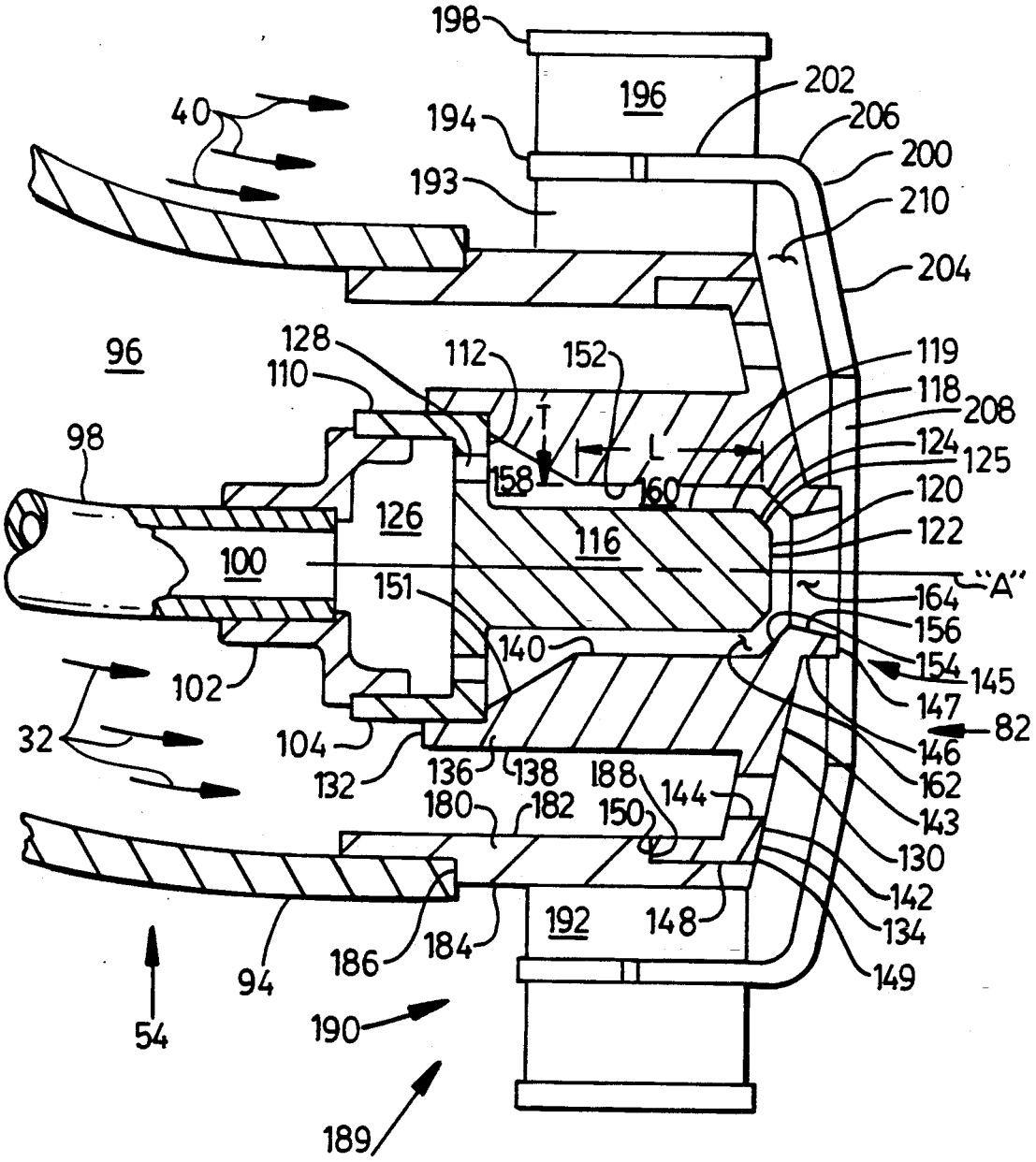
FIG. 3 is an enlarged sectional view near the outlet end of the gaseous fuel injector.
Figure 4:
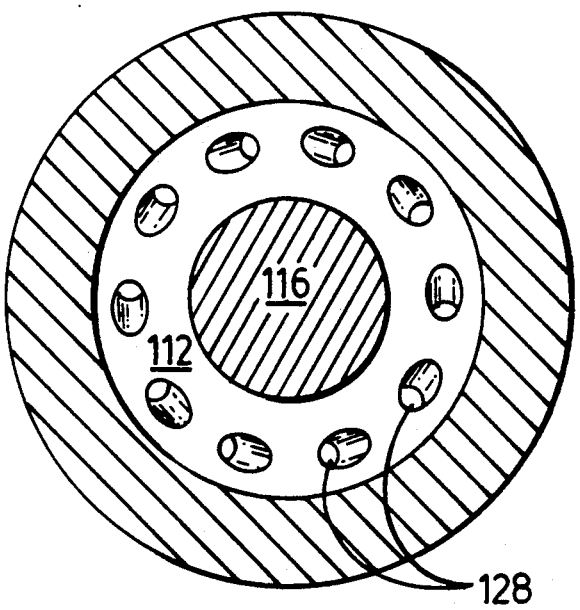
FIG. 4 is an enlarged end view of the injector taken along line 4—4 of FIG. 2.

As more clearly shown in FIGS. 2 and 3, the fuel injector 54 includes an inlet end 80 and an outlet end 82. A manifold 84 is positioned at the inlet end 80 and includes a gaseous fuel inlet passage 86 and a threaded fitting 88 for communicating the flow of fuel 32 from the device 30 during operation of the engine 10. Further included in the manifold 84 is a second passage 90 which is connected by way of a threaded fitting 92 attached to the manifold 84 to a source of water. A housing 94 is fixedly attached at one end to the manifold 84. A passage 96 in the housing 94 is in fluid communication with the gaseous fuel inlet passage 86 in the manifold 84. A tube 98 is positioned within the housing 94 and is connected at one end to the manifold 84. The tube 98 includes a passage 100 being substantially centered at the outlet end 82 and in fluid communication with the second passage 90 in the manifold 84. At the end opposite the manifold 84, the tube 98 is connected to a first fitting 102 having a cylindrical shape, an axis A and being expanded into a second fitting 104 having an annular cylindrical shape. The second fitting 104 is coaxially attached to the first fitting 102. The second fitting 104 includes an annular cylindrical shaped portion 110, a face portion 112 connected to the annular portion 110 and a nose portion 116 connected to the face portion 112 and extends away from the first fitting 102. The nose portion 116 includes a cylindrical portion 118 having an outer surface 119 thereon and an end 120 with a predefined configuration. In this application, the configuration includes a flat portion 122 and a tapered portion 124 having an outer surface 125 thereon interconnecting the flat portion 122 and the cylindrical portion 118. In this application, the tapered portion 124 has an angle of approximately 45 degrees. A chamber 126 is formed between the first fitting 102 and the second fitting 104. A plurality of passages or orifices 128 are radially spaced an equal distance from the axis A and are positioned in the face portion 112 providing an exit from the chamber 126. As best shown in FIG. 4, each of the passages 128 has a preestablished size and is positioned at a tangential angle to the axis A. For example, the plurality of passages 128, in this application, include ten passages having an approximate diameter of between 2 and 3 mm, and the tangential angle of approximately 45 degrees to the axis A. As an alternative, the tangential angle could fall within the range of between 30 to 60 degrees without changing the gist of the invention.

Figure 5:
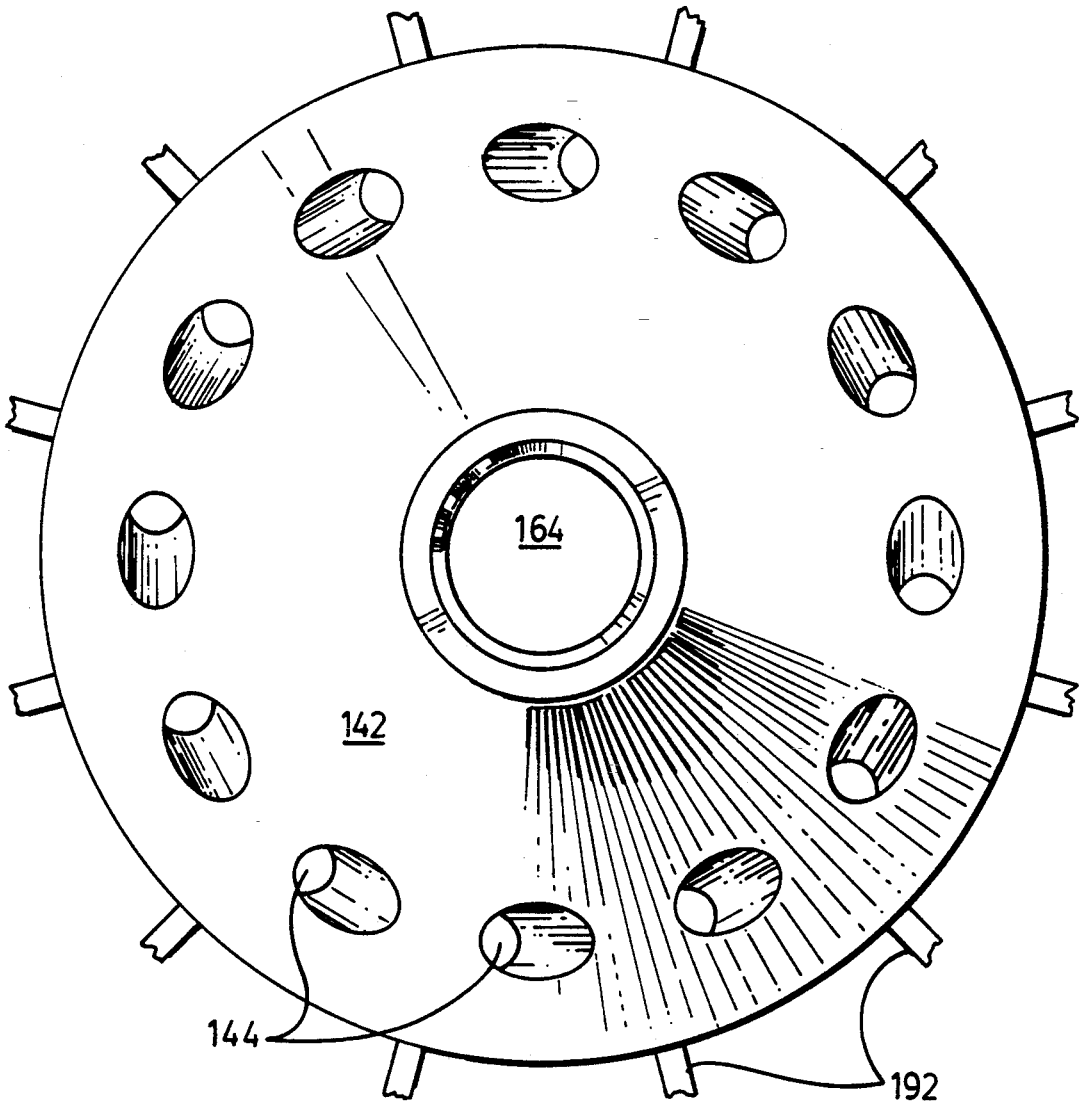
FIG. 5 is an enlarged end view of a portion of the injector taken along line 5—5 of FIG. 2.

The gaseous fuel injector 54 further includes a cylindrical diffuser portion 130 coaxially positioned about the axis A. The diffuser portion 130 is connected to the second fitting 104 and includes a first end 132 and a second end 134. The diffuser portion 130 further includes a cylindrical wall portion 136 having an outer surface 138, an inner surface 140 and a non-uniform cross sectional area, a radial flange 142 having an exit surface 143 and a plurality of passages 144 therein. The plurality of gaseous fuel passages 144 are radially spaced an equal distance from the axis A. As is best shown in FIG. 5, each of the passages 144 is positioned at a tangential angle to the axis A. For example, the plurality of passages, in this application, include twelve passages having an approximate diameter of between 2 and 3 mm, and the tangential angle of approximately 45 degrees to the axis A. As an alternative, the tangential angle could fall within the range of between 30 to 60 degrees without changing the gist of the invention. A tip portion 145 extends from the exit surface 143 and includes a cylindrical surface 146 being coaxial with the axis A and an end surface 147. The radial flange 142 is attached to the outer surface 138 of cylindrical wall portion 136 at the second end 134 and extends radially outwardly and generally toward the first end 132 forming an angle of about 80 degrees between the flange 142 and the outer surface 138. A cylindrical ring 148 having a first end 149 and a second end 150 is attached to the radial flange 142 at the first end 149. The second end 150 extends from the radial flange 142 toward the first end 132 of the diffuser portion 130. The inner surface 140 includes a first inwardly angled surface 151 extending generally from the first end 132 of the diffuser portion 130, a cylindrical surface 152 extending from the first inwardly angled surface 151 toward the second end 134 of the diffuser portion 130 and is spaced a preestablished distance from the outer surface 119 of the nose portion 116. Further included is a second inwardly angled surface 154 being spaced a preestablished distance from the outer surface 125 of the nose portion 116 and a third outwardly angled surface 156 extending from the second inwardly angled surface 154 to the end surface 147. The outer surface 119 of the nose portion 116 and the first inwardly angled surface 151 form a first cavity 158 having a partially trapezoidal shape. The outer surface 119 of the nose portion 116 and the cylindrical surface 152 of the diffuser portion 130 form a second cavity 160 having a rectangular shaped cross sectional area. The rectangular shape of the second cavity 160 has a preestablished length L and a preestablished thickness T. It has been concluded that a ratio of the length L to thickness T should be in the range of about 6 to 1. The tapered portion 124 of the nose portion 116 and the second inwardly angled surface 154 form a third cavity 162 having a partially trapezoidal shape. The end portion 120 of the nose portion 116 and the third outwardly angled surface 156 form a fourth cavity 164 having a partially trapezoidal shape. A means 166 for causing the swirling of water at the outlet end 82 includes the plurality of passages 128, the first cavity 158, the second cavity 160, the third cavity 162 and fourth cavity 164 which are in the water injection passage 100.

The fuel injector 54 further includes a cylindrical member 180 having an inner surface 182, an outer surface 184 and a pair of ends 186, 188. One end 186 is attached to the housing 94 and the other end 188 is attached to the ring 148 of the diffuser portion 130. The fuel injector 54 further includes a means 189 for directing and swirling a portion of the combustion air flow 40 into contact with the flow of fuel 32 exiting the exit surface 142 prior to entering the combustor section 22. The means 189 includes a swirler portion 190 having a plurality of vanes 192 extending outwardly from the outer surface 184. Each of the vanes 192 have a deflecting surface 193 thereon and each of the vanes 192 are attached to the outer surface 184 near the end 188. An intermediate ring 194 is positioned at the extremity of the plurality of vanes 192. The fuel injector nozzle further includes a plurality of vanes 196 attached to the intermediate ring 194 and extending outwardly therefrom and being attached to an outer ring 198. A generally cylindrical concave cup shaped cover 200 is also included in the fuel injector 54. The cover 200 is coaxially aligned with the axis A of the diffuser portion 130. The cover 200 further includes a generally annular cylindrical portion 202 being axially aligned with the intermediate ring 194, generally radially inwardly directed a deflector portion 204 connected to the cylindrical portion 202 by a portion 206 blending interconnecting therewith and an opening 208 being generally axially aligned with the axis A and positioned in the deflector portion 204. The deflector portion 204 is spaced a preestablished distance from the exit surface 142 of the diffuser portion 130 forming a passage 210 therebetween. For example, the preestablished distance D, in this application, is between 2 and 3 mm. The gaseous fuel injector further includes a means 212 for causing the swirling of the mixture of gaseous fuel 32 and a portion of the combustion air flow 40 includes the plurality of passages 144, the exit surface 143, the deflector portion 204, and the axial surface 147.

INDUSTRIAL APPLICABILITY

The gaseous fuel injection system 12 is used with the gas turbine engine 10 and has the ability to reduce costs resulting from savings on water as well as reduce the undesirable increase in specific fuel consumption of the gas turbine engine 10 resulting in savings in fuel cost. Furthermore, the high effectiveness of water for NOx emissions control results in a reduced amounts of unburned hydrocarbons, which are undesirable, and regulated pollutants in most industrialized countries.

The system 12 uses a plurality of gaseous fuel injectors 54 having water from an external source under a predetermined pressure injected therethrough. The water is introduced into each of the injectors through the second passage 90 and into the passage 100. From the passage 100, the water enters into the chamber 126 wherein a large reservoir of water is available to exit through the tangentially angled plurality of passages 128 forming jets of water and enter into the first cavity 158. As the water strikes and the first inwardly angled surface 151, a swirling action of the water is initiated. The tangentially angled plurality of passages 128 impart a high degree of angular momentum to the water. As the water contacts the nose portion 116 and enters into the second cavity 160 the preestablished length and thickness of second cavity 160 acts as an annular accelerating cavity causing the jets to mix uniformly while keeping the energy within the water at a high level. From the second cavity 160 the water strikes the inwardly angled surface 154 and exits through the third cavity 162 and into the fourth cavity 164. As the water strikes the outwardly angled surface 156, the water is spread in a thin film along the outwardly angled surface 156 moving toward the inlet end 24 of the combustion section 22. Thus, a thin film of water is deposited along the third outwardly angled surface 156 spreading radially outward as it is discharged at the inlet end 24 of the combustion section 22.

The combustion air flow 40 from the compressor section 26 is divided in to separate paths by the swirler portion 190 and directs a portion of the combustion air flow 40 into the passage 210 and into contact with the flow of fuel 32. This portion of the combustion air 40 passes through the plurality of vanes 192 along each of the deflecting surfaces 193 which imparts a swirling action to the combustion air 40 and then into the passage 210. The remainder of the combustion air flow 40 passes along the plurality of vanes 196 which also impart a swirling action to the remainder of the combustion air 40 prior to entering into the combustor section 22.

The gaseous fuel 32 used with the gaseous fuel injector 54 enters into each of the injectors 54 through the passage 86 and is communicated to the passage 96 from an external source under a preestablished pressure. Fuel 32 exits the passage 96 through the tangentially angled plurality of passages 144 into the passage 210 imparting a high degree of angular momentum to the gaseous fuel 32. The gaseous fuel 32 then partially mixes with the portion of the combustion air 40 directed into the passage 210. The gaseous fuel 32 and the incoming swirling combustion air 40, which have generally the same direction of angular momentum, are partially premixed prior to entering the combustion section 22. The premixed combustion air 40 and gaseous fuel 32 and the thin film of water have generally the same direction of angular momentum and are aerodynamically vectorially additive. The swirling action of the partially premixed combustion air and persisting high angular momentum jets of gaseous fuel 32 exiting from the passages 144 cause the thin film of water with high angular momentum to atomize into fine droplets by the shearing action. The resulting mixture of combustion air 40, gaseous fuel 32 and water droplets has a high angular momentum and continues to spread radially outward and further mixes with the remaining combustion air 40 entering the combustion chamber 50 through the plurality of vanes 196. Due to the fact that the water droplets have a higher density than the gaseous fuel 32 and combustion air 40 within the mixture, the angular momentum of the water droplets starts centrifuging the droplets radially outwardly resulting in good dispersion of water droplets throughout the gaseous fuel 32 combustion air 40 mixture. This results in high effectiveness of mixing of the injected water with the air and fuel, thus, reducing NOx emission and providing a fuel and water efficient combustion process.

Other aspects, objects and advantages of this invention can be obtained from a study of the drawings, disclosure and the appended claims.

I claim:

1. A gas turbine engine including a gaseous fuel injector comprising:

a turbine section having a gas producing section;

a combustor section being positioned in working relationship to the turbine section and having an inlet end and an outlet end, said conbustor section further having an outlet flow exiting the outlet end for driving the turbine section;

a compressor section being driven by the gas producing section of the turbine section and having an air flow therefrom, a portion of said air flow being in fluid communication with the inlet end of the combustor section;

a device for causing a flow of fuel during operation of the gas turbine engine;

said gaseous fuel injector including an outlet end having an exit surface thereon, a water injection passage being substantially centered at the outlet end and having an axis A, a plurality of gaseous fuel passages surrounding the water injection passage at the outlet end and existing beyond the exit surface and having the flow of fuel exiting therethrough during operation of the gas turbine engine;

means for directing and swirling a portion of the air flow into contact with the flow of fuel exiting the exit surface prior to entering the combustor section;

means for causing the swirling of the gaseous fuel and the combustion air flow prior to entering the combustor section;

means for causing the swirling of water at the outlet end, said means for causing the swirling of the water at the outlet end being positioned din the water injection passage; and each of said directing and swirling means inputing an angular momentum which is aerodynamically verctorially additive.

2. The gas turbine engine of claim 1 wherein said means for directing and swirling a portion of the air flow into contact with the flow of fuel exiting the exit surface prior to entering the combustor section includes a cup shaped cover operatively supported relative to the fuel injector, said cover having a generally annular cylindrical portion positioned within the portion of the air flow being in fluid communication with the inlet end of the combustor section, a generally radially inwardly directed deflector portion having an opening generally centered therein and being generally axially aligned with the water injection passage, and a portion blendingly interconnecting the cylindrical portion and the deflector portion.

3. The gas turbine engine of claim 2 wherein there is a passage between the deflector portion and the exit surface.

4. The gas turbine engine of claim 2 further including an outer ring and an intermediate ring, said intermediate ring being concentrically aligned and fixedly attached to the generally annular cylindrical portion of the cup shaped cover.

5. The gas turbine engine of claim 4 further including a cylindrical member operatively associated with the fuel injector and having a plurality of vanes projecting outwardly therefrom positioned in contacting relationship with the air flow and having a deflecting surface thereon.

6. The gas turbine engine of claim 1 wherein said means for causing the swirling of the gaseous fuel and the combustion air includes a plurality of gaseous fuel passages positioned annularly about the water injection passage.

7. The gas turbine engine of claim 6 wherein each of the gaseous fuel passages are evenly spaced annularly about the water injection passage.

8. The gas turbine engine of claim 7 wherein said plurality of gaseous fuel passages exit the exit surface at an angle other than perpendicular to the exit surface.

9. The gas turbine engine of claim 8 wherein each of the gaseous fuel passages is positioned at a tangential angle to the axis A.

10. The gas turbine engine of claim 9 wherein the angle at which the gaseous fuel passage exits the exit surface is in the range of between 30 and 60 degrees.

11. A gaseous fuel injector adapted for use with a gas turbine engine having a combustor section, a device for causing a flow of fuel and a compressor section for causing a combustion air flow, the gaseous fuel injector comprising:

an outlet end having an axis A and an exit surface thereon;

a water injection passage having a flow of water therein during operation of the gas turbine engine and being substantially centered at the outlet end;

a plurality of gaseous fuel passages surrounding the water injection passage at the outlet end and exiting through the exit surface so that during operation of the gas turbine engine, a flow of fuel can exit therethrough;

means for directing and swirling a portion of the combustion air flow into contact with the flow of fuel prior to entering the combustor section during operation of the gas turbine engine;

means for causing the swirling of the gaseous fuel and the combustion air flow prior to entering the combustor section;

means for causing the swirling of water at the outlet end, said means for causing the swirling of the water at the outlet end being positioned in the water injection passage; and each of said directing and swirling means inputing an angular momentum which is aerodynamically vectorially additive.

12. The gaseous fuel injector of claim 11 wherein said means for directing and swirling a portion of the air flow into contact with the flow of fuel exiting the exit surface prior to entering the combustor section includes a cup shaped cover attached to the fuel injector, said cover having a generally annular cylindrical portion positioned with the piston of the air flow being in fluid communication with the inlet end of the combustor section, a generally radially inwardly directed deflector portion having an opening generally centered therein and being generally axially aligned with the water injection passage, and a portion blendingly interconnecting the cylindrical portion and the deflector portion.

13. The gaseous fuel injector of claim 12 wherein there is a passage between the deflector portion and the exit surface.

14. The gaseous fuel injector of claim 12 further including an outer-- ring- and an intermediate ring, said intermediate ring being concentrically aligned and fixedly attached to the generally annular cylindrical portion of the cup shaped cover.

15. The gaseous fuel injector of claim 14 further including a cylindrical member operatively associated with the fuel injector and having a plurality of vanes projecting outwardly therefrom positioned in contacting relationship with the air flow and having a deflecting surface thereon.

16. The gaseous fuel injector of claim 11 wherein said means for causing the swirling of the gaseous fuel and the combustion air includes a plurality of gaseous fuel passages positioned annularly about the water injection passage.

17. The gaseous fuel injector of claim 16 wherein each of the gaseous fuel passages are evenly spaced annularly about the water injection passage.

18. The gaseous fuel injector of claim 17 wherein said plurality of gaseous fuel passages exit the exit surface at an angle other than perpendicular to the exit surface.

19. The gaseous fuel injector of claim 18 wherein each of the gaseous fuel passages is positioned at a tangential angle to the axis A.

20. The gaseous fuel injector of claim 19 wherein the angle at which the gaseous fuel passage exits the exit surface is in the range of between 30 and 60 degrees.

21. The gaseous fuel injector of claim 11 wherein said means for causing the swirling of water includes a first cavity having a partially trapezoidal shape, a second cavity having a rectangular shape, a third cavity having a partially trapezoidal shape and a fourth cavity having a trapezoidal shape.

22. The gaseous fuel injector of claim 21 wherein said first cavity includes a first inwardly angled surface, and the third cavity includes a second inwardly angled surface.

23. The gaseous fuel injector of claim 22 wherein said fourth cavity includes a outwardly angled surface.

24. The gaseous fuel injector of claim 11 wherein said means for causing the swirling of water includes a face portion having a plurality of water passages positioned therein, each of said plurality of water passages being at an angle other than perpendicular to the face portion.

25. The gaseous fuel injector of claim 24 wherein each of the water passages is positioned at a tangential angle to the axis A.

26. The gaseous fuel injector of claim 25 wherein the angle at which the water passages exits the face portion is in the range of between 30 and 60 degrees.

27. The gaseous fuel injector of claim 24 wherein said means for causing the swirling of water further includes a first cavity having a partially trapezoidal shape, a second cavity having a rectangular shape, a third cavity having a partially trapezoidal shape and a forth cavity having a trapezoidal shape.

* * * * *

UNITED STATES PATENT AND TRADEMARK OFFICE

CERTIFICATE OF CORRECTION

PATENT NO. : 5,146,741

DATED : September 15, 1992

INVENTOR(S) : Virendra M. Sood

It is certified that error appears in the above-identified patent and that said Letters Patent is hereby corrected as shown below:

Claim 1, column 7, line 30, delete "din" and insert --in--.

Claim 12, column 8, line 48, delete "with" and insert --within--, also delete "piston" and insert --portion--.

Claim 14, column 8, line 59, delete "--" and "-".

Signed and Sealed this

Twelfth Day of October, 1993

*Attest:*

*Attesting Officer*

BRUCE LEHMAN

*Commissioner of Patents and Trademarks*